United States Patent [19]

Denney et al.

[11] Patent Number: 4,586,436

[45] Date of Patent: May 6, 1986

[54] ELECTRONIC ASSEMBLY FOR MODERATE HARD TARGET PENETRATOR FUZE

[75] Inventors: James R. Denney; Robert L. Stehr, both of Ridgecrest, Calif.

[73] Assignee: The United States of America as represented by the Secretary of the Navy, Washington, D.C.

[21] Appl. No.: 650,032

[22] Filed: Sep. 13, 1984

[51] Int. Cl.[4] ..... F42C 11/00

[52] U.S. Cl. ..... 102/206; 102/200; 102/208

[58] Field of Search ..... 102/208, 206, 215, 200, 102/265, 266, 270

[56] References Cited

U.S. PATENT DOCUMENTS

| | | | |
|---|---|---|---|
| 3,703,145 | 11/1972 | Burkhardt et al. | 102/270 |
| 3,914,732 | 10/1975 | Brumleve et al. | 102/215 |
| 3,961,577 | 6/1976 | O'Steen | 102/208 |
| 4,002,123 | 1/1977 | Fisher | 102/208 |
| 4,044,680 | 8/1977 | Ziemba | 102/215 |
| 4,089,268 | 5/1978 | Jaroska et al. | 102/208 |
| 4,091,734 | 5/1978 | Redmond et al. | 102/215 |
| 4,136,617 | 1/1979 | Fowler | 102/206 |
| 4,254,475 | 3/1981 | Cooney et al. | 102/215 |
| 4,541,341 | 9/1985 | Fowler et al. | 102/215 |

*Primary Examiner*—Charles T. Jordan

*Attorney, Agent, or Firm*—Robert F. Beers; W. Thom Skeer; W. D. English

[57] ABSTRACT

A microcomputer controlled electronic fuze capable of surviving a hard target impact is disclosed comprising two epoxy potted printed circuit boards mounted back to back of which one of the boards is designed to survive impact and contains the microcomputer controller, storage charge, timing circuit, and fire pulse detonator circuit. The other board carries an electric motor drive circuit for mechanical timing and detonator alignment, a detonation delay command storage circuit, and an AC rectifier and voltage regulator circuit coupling a wind turbine generator power supply to the fuze.

21 Claims, 6 Drawing Figures

*Moderate Hard Target Penetrator Fuze Software*

ELECTRONIC ASSEMBLY FOR MODERATE HARD TARGET PENETRATOR FUZE

BACKGROUND OF THE INVENTION

1. Field of the Invention

The invention relates generally to an electronic, microcomputer controlled, ordnance fuze capable of operating independently of the ordnance carrier (aircraft) upon separation therefrom and that is capable of withstanding and surviving a hard target impact. More specifically, the invention relates to a highly compact, impact resistant electronic fuze logic and detonation circuit adaptable to different weapons systems and capable of operating through and after an estimated 100,000 g impact.

2. Description of the Prior Art

Various aircraft weapons systems, Fuze Function Control Sets (FFCS), are presently in military armanent inventory. Among these are sets capable of selecting one of four fuzing modes, e.g. proximity, instantaneous upon impact, or one or two detonation delay times after impact, by applying a specific DC voltage to the electric bomb fuze at the time the weapon is released. The voltage levels used, ±300 and ±195 volts DC, are transmitted via a single umbilical cable between the aircraft and the weapon.

Future incorporation of newer, more advanced weapons systems is anticipated. Since present state of the art fuze technology does not have the flexibility to accommodate both new and old weapons systems, there exists a continuing need for a versatile electronic fuze that can conveniently adapt to either system in order that different aircraft having different FFCS weapons systems may carry similar ordnance.

In addition, there exists a need for an electronic fuze that can also accept ground set arming time, fire pulse and detonation delay programming switch inputs, that can accept ordnance air brake drag sensor inputs, that can accept proximity sensor inputs, and that can accept contact sensor inputs.

A variety of electronic, mechanical and electromechanical ordnance fuze devices have been disclosed in the prior art; however, though sufficient for the intended purpose at the time, none of the prior art devices has the capability to satisfy all of the above requirements.

Furthermore, the present electronic fuze invention was designed to sustain a 100,000 g impact, to be able to pierce a hard target, and survive to detonate on the other side (inside) of the target.

Because of the unreliability of mechanical switches under high impact, there also exists a need to hard wire the detonator of an ordnance explosive to the fire pulse circuit of the fuze. To avoid a mechanical escapement, an electrical motor-driven explosive train alignment mechanism is used. It is further desired to control this motor with a capability of recycling should a mishap occur.

It has been found that a microcomputer incorporated into a condensed and firmly potted electronic fuze package can do all of the above, which none of the prior art electronic fuzes were capable of so doing.

Power to the fuze and microcomputer in the present invention is derived, as with other prior art devices, from a wind turbine generator which begins operation and activates the electronic fuze when the bomb is released. No power is applied to the fire circuit, therefore, until the bomb is released. The fuze logic and fire circuit of the present invention, however, are required to operate through and after an estimated 100,000 g impact caused by penetrating four feet of reinforced concrete at 1300 feet/second. In none of the prior art is there a capability for the fuze circuit to operate after loss of the wind turbine power source and to survive a 100,000 g impact to provide detonation after penetration of a target.

Accordingly, there exists today a great need for a microcomputer controlled electronic bomb fuze capable of receiving several sensor and command inputs, and executing various electro-mechanical arming times and detonation delay times, and further that is capable of surviving a hard target impact to detonate a short time later.

SUMMARY OF THE INVENTION

The invention is a hard target, impact survivable, microcomputer controlled, electronic fuze package for freefall bomb ordnance comprising multiple circuits on two printed circuit boards (PCB) potted and mounted back to back. One of said PCBs is capable of surviving a 100,000 g impact and contains a timing circuit, a microcomputer controller, capable of receiving a plurality of sensor and variable command data inputs, an electrical energy storage circuit to keep the microcomputer, logic, and timing circuits alive post impact when the external wind turbine generator power source is lost, and a fire pulse electrical energy storage circuit and fire pulse detonator circuit. The other PCB need not survive impact and contains a motor drive and stall sensor circuit for mechanical timing and detonator alignment, an AC rectifier and voltage regulator circuit to provide +100 V, +6 V, and +5 V power sources from the external wind turbine generator, and a ±195/±300 V arming time/detonation delay command storage circuit.

OBJECTS OF THE INVENTION

Accordingly, an object of the invention is to provide an ordnance fuze having a plurality of arming modes and detonation delay options, selectable by the pilot while in flight, as an override to preprogrammed modes and delays set into the fuze prior to flight.

Another object of the invention is to provide an ordnance fuze that is automatically armed, dependent on the delivery mode, thereby precluding the chance of human error.

A still further object of the invention is to provide an ordnance fuze whose detonation options are selectable by utilizing direct current voltages from the aircraft to the fuze at the moment the bomb leaves the aircraft.

Another object of the invention is to provide a high impact survivable ordnance fuze that is both compact and reliable.

Another object of the invention is to provide an electronic, digital, delayed detonator fuze whose delay may be set while the fuze is in flight.

A further object of the invention is to use a single chip microcomputer for versatility in programming arming and detonation delay times.

Another object of the invention is to provide a versatile fuze interface to various different cockpit fuze function control sets.

Another object of the invention is to provide fuze interfacing capability with "on the ground" arming time and fire pulse delay programming switches, drag sensor inputs, proximity sensor inputs, contact sensor inputs, and mechanical safe-arm (SA) sensor inputs.

A further object of the invention is to integrate an EPROM microcomputer into an electronic fuze package to control the mechanical SA detonation alignment device and the mechanical arm delay function.

Other objects and advantageous features of the invention will become more apparent in a description of a specific embodiment thereof, given by way of example only, to enable one skilled in the art to readily practice the invention which is described hereinafter with reference to the accompanying drawings.

DESCRIPTION OF THE PREFERRED EMBODIMENT

The electronic assembly invention for a moderate hard target penetrator fuze is actually a part of an electromechanical Safe and Arm (SA) fuze system for a bomb capable of withstanding a 100,000 g impact to penetrate a steel reinforced concrete barrier four feet thick before exploding on the other side of the barrier. To do so, certain electronic components of the fuze within the bomb must not only survive to function after impact, but also must be capable of storing and delivering a post impact fire pulse to an explosive lead and detonator to explode the bomb once through the barrier.

Figure 1:
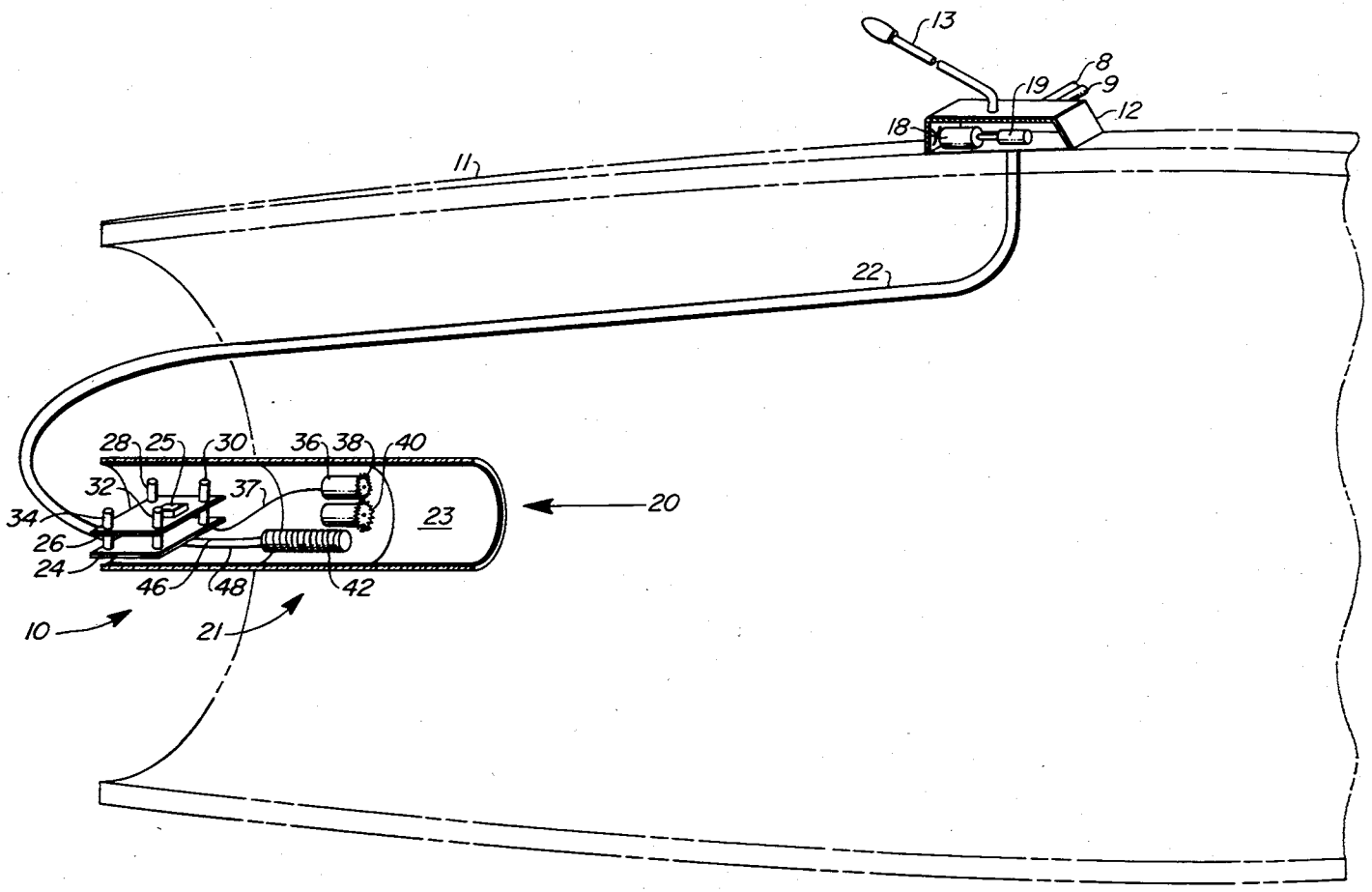
FIG. 1 describes the environment of the electronic assembly for a moderate hard target penetrator fuze.

FIG. 1 describes the general physical environment and location of the compact electronic assembly 10 for a moderate hard target penetrator fuze. A typical hard target penetrator bomb 11, of the type for which the electronic assembly 10 is designed, is provided with a bomb saddle 12 having a lanyard 13 that is removably engaged with a bomb rack of the aircraft carrying bomb 11.

A wind turbine generator 18 provided with a step down transformer 19 contained within saddle 12 provides power to electronic assembly 10 after bomb 11 is released from the aircraft and before impact with a target. A cable 22 interconnecting saddle 12 and electronic assembly 10 carries both aircraft code commands (±195 volts and ±300 volts) from lanyard 13 and also electrical power (+100 volts and ±50 volts) from wind turbine generator 18 and step down transformer 19.

Electronic assembly 10 is part of a cylindrical bomb fuze 20, greatly enlarged in FIG. 1 for clarity, comprising, in addition to electronic assembly 10, a mechanical SA mechanism 21 and a booster charge 23. Electronic assembly 10 comprises a first printed circuit board (PCB) 24 mounted back-to-back with a second PCB 26, both of which are held in rigid position by four mounting pins 28, 30, 32, and 34. A microcomputer 25 is mounted on second PCB 26. Electronic assembly 10 is also encapsulated with an epoxy potting compound to maintain rigidity during a 100,000 g impact. The potting compound used in the present embodiment may be Stycast 26/51 manufactured by Emerson and Cumings. Although it is not necessary that first PCB 24 survive impact, it is a requirement that second PCB 26 and the components thereon survive impact to enable detonation of bomb 11 a brief period post impact.

Mechanical SA mechanism 21 operates in cooperation with electronic assembly 10. Upon release of bomb 11 from the aircraft, wind turbine generator 18 activates, supplying power to electronic assembly 10, which enables an electric motor 36 through a motor lead 37 to run forward, stall, then run reverse and stall again to provide for an SA mechanical time delay and to align through a first and a second meshed gears 38 and 40 an explosive lead and detonator in a detonator housing 42. Once mechanically timed and aligned, the detonator in housing 42 is capable of detonation into a booster charge 23. A pair of detonation leads 46 and 48 provide a pulse to detonate an explosive lead and detonator in housing 42, after a predetermined electronic time delay in microprocessor 25, which detonates booster charge 23, which in turn detonates the explosives in bomb 11.

Figure 2:
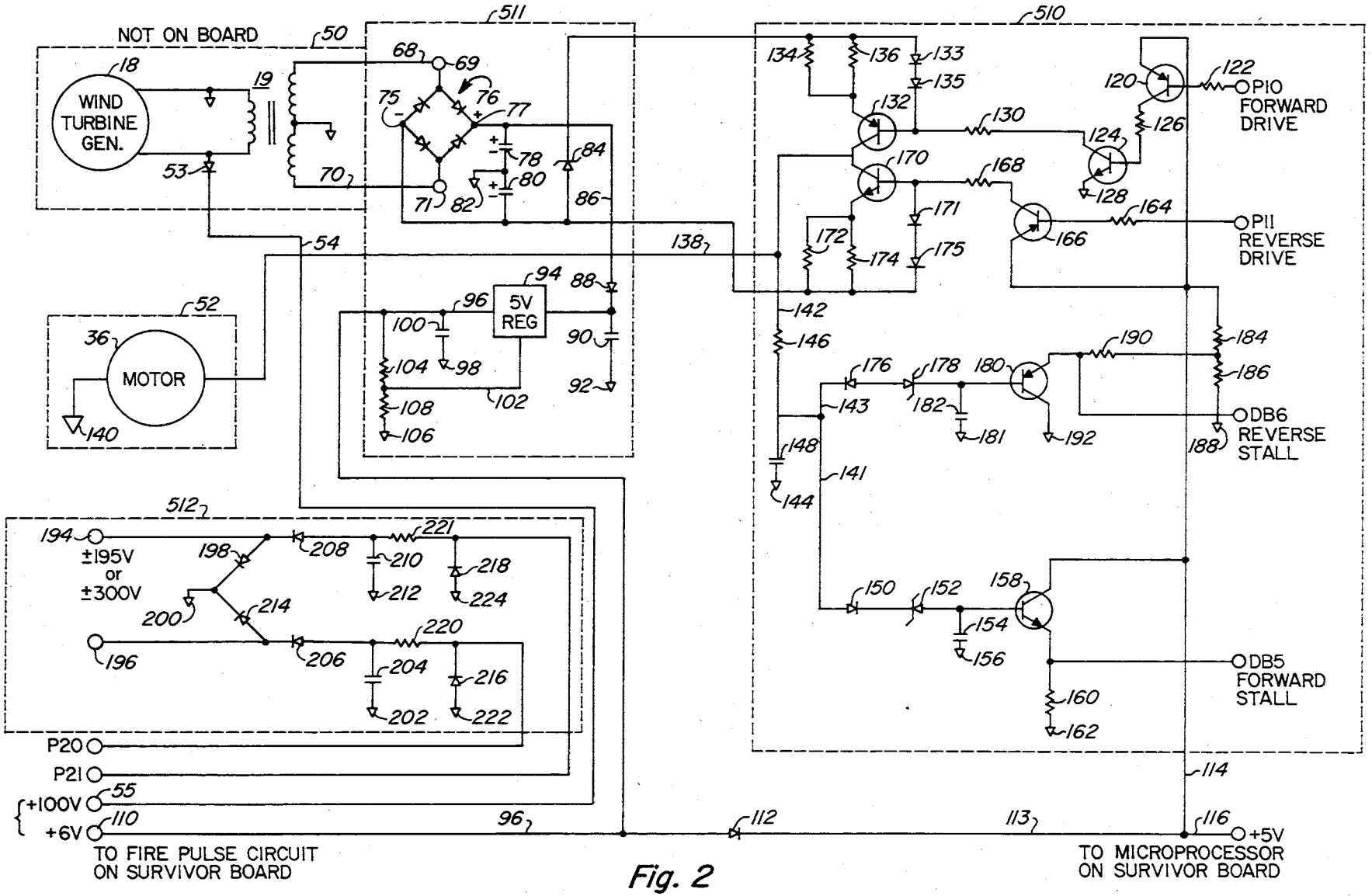
FIG. 2 is a schematic for the power circuits and motor drive circuits of the non-surviving PCB.

Referring now to FIG. 2, a detailed schematic of first PCB 24 is illustrated. Dashed box 50 encloses wind turbine generator 18 and step down transformer 19, and dashed box 52 encloses electric motor 36. It should be understood that components in dashed boxes 50 and 52 are not on first PCB 24, reference FIG. 1, but are provided in FIG. 2 for clarity of understanding their interrelationship and function with a motor arm time control/drive circuit on first PCB 24 outlined by dashed box 510. The remainder of PCB 24 in FIG. 2 is a power conversion circuit, dashed box 511, and a detonation delay/fuze mode code storage circuit, dashed box 512.

Figure 3:
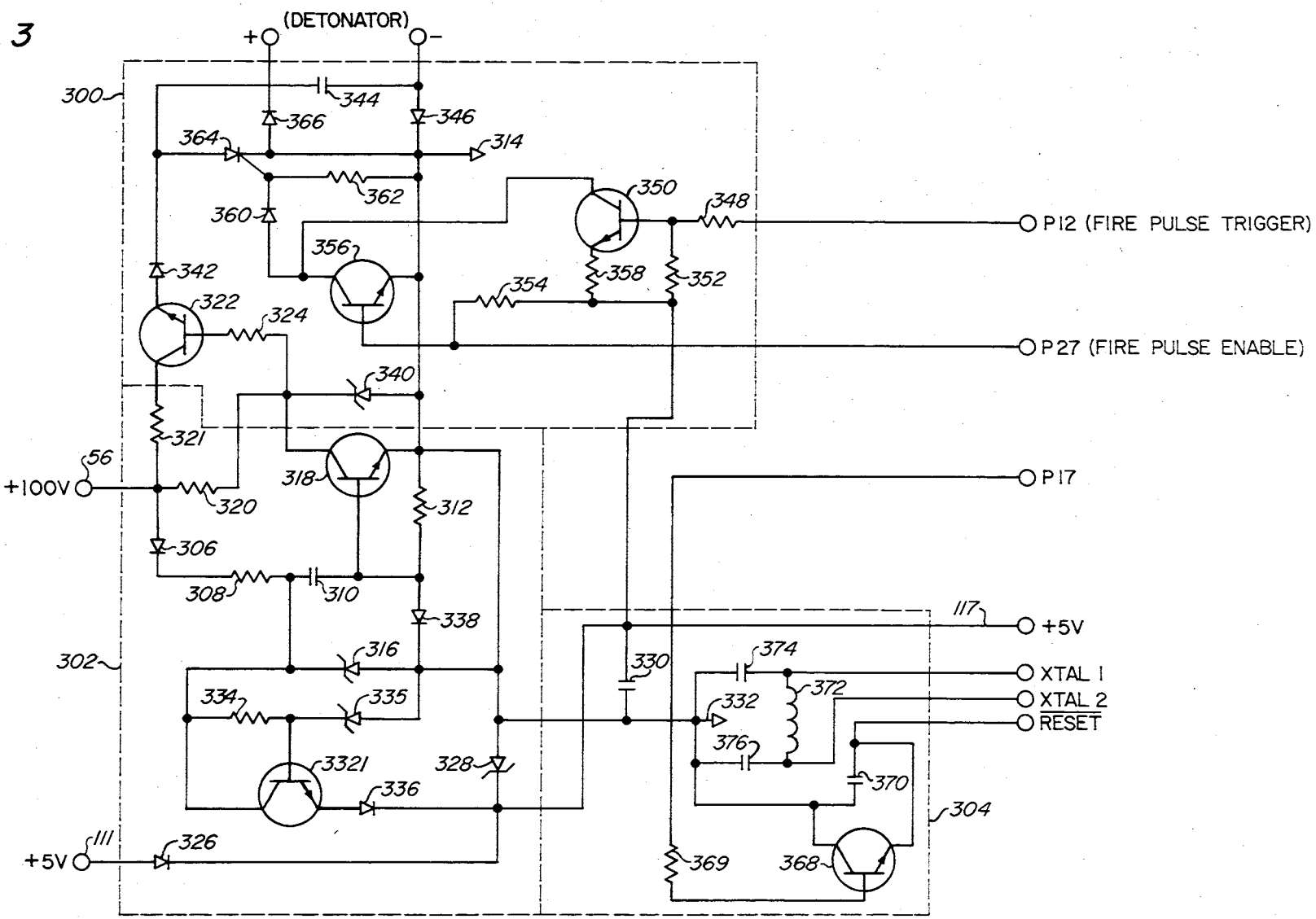
FIG. 3 is a schematic for the fire pulse generator and storage circuit, the microcomputer keep alive circuit and the timing circuit of the survivor PCB.

Upon release of bomb 11 from the aircraft and prior to target impact, wind turbine generator 18 generates approximately 5 watts at 100 volts of power to electronic assembly 10 through cable 22 (FIG. 1). A positive 100 volts is directly supplied from generator 18 through a diode 53 (1N4942) along a 100 volt lead 54 in cable 22 to a first 100 volt terminal 55 on first PCB 24. First 100 volt terminal 55 is then coupled to a second 100 volt terminal 56 on second PCB 26 (FIG. 3).

Wind turbine generator 18 also supplies a ±50 volts through step down transformer 19 along a first and a second 50 volt leads 68 and 70, in cable 22, to a first and a second 50 volt terminals 69 and 71 on first PCB 24.

A bridge DC/full wave rectifier 76 (BE6930) of power conversion circuit 511, conventionally comprising four diodes, is coupled between first and second 50 volt terminals 69 and 71, thereby providing an AC rectified negative 50 volt terminal 75 and an AC rectified positive 50 volt terminal 77. Two series capacitors, 78 and 80, (50 volt/15 microfarads each) are coupled in series between negative terminal 75 and positive terminal 77. A ground 82 is coupled between capacitors 78 and 80, and a zener diode 84 (58 volt/1 watt) is coupled in parallel with capacitors 78 and 80.

The circuit thus described functions in such manner that when the AC current coming out of transformer 19 is a positive 50 volts and passes through rectifier 76, it exits through positive terminal 77 and positively charges capacitor 78 to approximately +30 volts. Correspondingly, when the AC current coming out of transformer 19 is a negative 50 volts and passes through rectifier 76, it exits through negative terminal 75 and negatively charges capacitor 80 to approximately −30 volts. Zener diode 84 being in parallel with series capacitors 78 and 80 and having a 58 volt threshold effectively limits the charge across capacitors 78 and 80 to approximately 60 volts (+30 to −30); i.e. current will flow from positive capacitor 78 through zener diode 84 to negative capacitor 80 and to ground 82 when the 58 volt threshold of zener diode 84 is exceeded. Coupling series capacitors 78 and 80 to ground 82 attenuates AC rectified ripple. Capacitors 78 and 80 further function to store charge and level out power that drives motor arm time control/drive circuit 510, motor 36, and components on second PCB 26 (FIG. 3). Capacitor 78 is charged up to +30 volt to drive motor 36 forward, and capacitor 80 is charged up to −30 volt to drive motor 36 in reverse.

To provide transistor circuits and microcomputer 25 (FIG. 4) power levels, a lead 86 couples positive terminal 77 (+50 volts) of rectifier 76 through a diode 88 (1N4942) to a 5 volt regulator 94 (CK06) to provide a 6 volt output lead 96 to a first PCB +6 volt terminal 110. First PCB +6 volt terminal 110 is in turn coupled to a second PCB +6 volt terminal 111 (FIG. 3). Capacitor 90 (1 microfarad/50 volt) couples lead 86 to ground 92 for filtering purposes. Six volt output lead 96 is likewise coupled to ground 98 through a capacitor 100 (0.1 microfarad/50 volt) for filtering purposes. A feedback loop 102 for regulator 94 is coupled between series resistors 104 (5KΩ) and 108 (160Ω), acting as a voltage divider, to ground 106 for regulation of regulator 94.

Six volt output lead 96 is further coupled through a diode 112 (1N4942) to provide a 5 volt lead 113 to a first PCB +5 volt terminal 116. First PCB +5 volt terminal 116 is in turn coupled to a second PCB +5 volt terminal 117 (FIG. 3).

Motor arm time control/drive circuit, dashed box 510, the mechanical arm time control circuit, is controlled by microcomputer 25 (FIG. 4) on second PCB 26 which in turn is activated (turned on) when wind turbine generator 18 begins to generate power, i.e. when bomb 11 is released. Motor 36 is first driven forward by a low assertion command from microcomputer 25 at terminal P10 (forward drive). Terminal P10, normally high, connects to the base of a transistor 120 (2N2907) through a resistor 122 (10KΩ). The emitter of transistor 120 is coupled to +5 volt power terminal 116, the collector of transistor 120 is coupled to the base of a transistor 124 (2N2222) through a resistor 126 (5KΩ), such that when the base of transistor 120 is commanded low at terminal P10, transistor 120 turns on allowing current to flow from emitter to collector through resistor 126 enabling a high in the base of transistor 124. A high on the base of transistor 124 turns transistor 124 on and enables current to flow from collector to emitter to ground 128. Transistor 124 is coupled through a resistor 130 (600Ω) to the base of a transistor 132 (2N5194). When the base of transistor 132 goes low due to the current flow to ground through transistor 124, transistor 132 turns on and allows positive current, power, to flow from wind turbine generator 18 and capacitor 78 through parallel resistors 134 and 136 (5Ω each) to emitter through base and collector of transistor 132 to a motor lead 138 which drives motor 36 forward, the circuit being completed through ground 140. Series diodes 133 and 135 (1N4148) couple the base of transistor 132 to capacitor 78 to provide a constant voltage source to the base of transistor 132 and making transistor 132 a constant current source.

When motor 36 is driven forward for a predetermined amount of time it reaches a forward stall position. This forward stall position is sensed by microprocessor 25 as follows. At the forward stall position, voltage across motor 36 drops as current through stalled motor 36 increases. A stall lead 142 couples motor lead 138 to ground 144 through a resistor 146 (100KΩ) and a filtering capacitor 148 (0.27 microfarads/50 volts). When motor 36 is running (not stalled) the voltage across motor 36 is sufficient to drive positive current along a forward stall lead 141 through a positive steering diode 150 (1N914), through an 8 volt zener diode 152 (1N756A) to the base of a transistor 158. A forward stall capacito 154 (0.01 microfarads/50 volts) to ground 156 is provided for filtering stability. The high voltage from the running motor imposes a high on the base of a transistor 158, which keeps transistor 158 on, allowing current to flow from +5 volt terminal 116 to ground 162 which imposes a high on a terminal DB5 of microcomputer 25.

However, when motor 36 reaches its forward stall position, current through motor 36 increases and voltage across motor 36 drops below the threshold voltage for zener diode 152, thereby imposing a low on the base of transistor 158, effectively shutting it off, and thereby setting a low on microcomputer 25 terminal DB5, indicating a forward stall.

Subsequent to receiving a forward stall command, to drive motor 36 in reverse, microcomputer 25 asserts a low on a reverse drive terminal P11. A low on terminal P11, through a resistor 164, (5KΩ) to the base of a transistor 166 (2N2907) enables transistor 166 to turn on conducting current from +5 volt power source 116 through the emitter and collector of transistor 166 through a resistor 168 (930Ω) to the base of a reverse drive transistor 170, (2N5191) by setting a high on said base. A high on the base of transistor 170 turns transistor 170 on causing negative current to flow from capacitor 80 through parallel resistors 172 and 174 (5Ω each) through the emitter, base and collector of transistor 170, to motor 36, and hence to ground 140. The negative current causes motor 36 to run in a reverse direction. Series diodes 171 and 175 couple the base of transistor 170 (2N5191) to second capacitor 80 to provide a steady negative current source to the base of transistor 170.

Once motor 36 has run its course in reverse, it reaches a reverse stall. As described earlier in the forward stall process, the negative voltage across motor 36 when running is sufficient to flow along reverse stall lead 143 through a second steering diode 176 (1N914), through a 9.1 volt zener diode 178 (1N960) to the base of a transistor 180, again coupled to ground 181 for stability through a reverse stall capacitor 182 (0.01 microfarads/50 volts). A high negative voltage on the base of transistor 180 locks transistor 180 on, and causes current to flow from +5 volt terminal 116 through a resistor 184 (2KΩ) through a series resistor 190 (30Ω) and through emitter, base, and collector of transistor 180 to ground 192. A resistor 186 (3KΩ) in series with resistor 184 couples +5 volt terminal 116 to ground 188 and functions as a voltage divider. The current flow through transistor 180 causes a low to be induced on a reverse stall terminal DB6 of microcomputer 25 indicating motor 36 is running in reverse.

However, again when motor 36 stalls the negative current through motor 36 increases causing negative voltage across motor 36 to decrease. With a decrease in negative voltage, zener diode 178 shuts off, which shuts off transistor 180 enabling terminal DB6 to go high, indicating a reverse stall to microcomputer 25. A reverse stall indication on terminal DB6 of microcomputer 25 indicates to microcomputer 25 that motor 36 has run its course for mechanical timing purposes and further that the fuze is mechanically aligned for detonation.

The remaining circuit on first PCB 24 is detonation delay/fuze mode code storage circuit 512, which provides for the aircraft encoding means. A ±195 volt or a ±300 volt is carried along lanyard 13 and cable 22 (FIG. 1) to a first and second coding terminals 194 and 196 on first PCB 24 prior to separation of bomb 11 from the aircraft.

If first coding terminal 194 is +195 volt or +300 volt, then current passes from first coding terminal 194 through a diode 198 (1N4007) to a ground 200. Ground 200 couples through a ground 202 through a capacitor 204 (0.068 microfarad/600 volts) and through a diode 206 (1N4007) to second data terminal 196, thereby charging capacitor 204 to a −195 or −300 volts, respectively.

Correspondingly, if first coding terminal 194 is −195 volt or −300 volt, then negative current flows through a diode 208 (1N4007) and through a capacitor 210 (0.068 microfarad/600 volts) to a ground 212 which is coupled to ground 200 and allows current flow through a diode 214 (1N4007) to second coding terminal 196, effectively charging capacitor 210 to −195 or −300 volts, respectively.

Capacitors 204 and 210 then gradually bleed off through diodes 216 and 218 (1N914 each) and resistors 220 and 221 to grounds 222 and 224, respectively. Coding information on capacitors 204 and 210 is later read by terminals P20 and P21 of microcomputer 25 on second PCB 26, thereby providing four states of coded information, i.e. two negative voltage levels on two different capacitors.

It should be understood from the above description that if first coding terminal 194 is ±195 or ±300 volt, then second coding terminal 196 is at zero volts. Correspondingly, if second coding terminal 196 is at ±195 or ±300 volts then first coding terminal 194 will be at zero volts and the circuit functions as described above but with reverse current flow.

Referring now to FIG. 3, a detailed schematic of second PCB 26 is provided. A fire pulse circuit is delineated by dashed box 300, a power storage circuit/keep alive circuit is delineated by dashed box 302, and a timing and reset circuit is delineated by dashed box 304. Microcomputer 25, also on second PCB 26, will be addressed in FIG. 4.

In FIG. 3, second PCB +100 volt terminal 56 supplies power from wind turbine generator 18 as described earlier. Whem bomb 11 is released and generator 18 turns on, 100 volts pass through a diode (1N4942) 306 in keep alive circuit 302, through a resistor 308 (12KΩ) to charge a keep alive capacitor 310 (50 microfarad/50 volt), hence through a series resistor 312 (1KΩ) to a ground 314. Keep alive capacitor 310 is wired in parallel with a 47 volt zener diode 316 (1N4756A). Therefore, the charge on keep alive capacitor 310 is limited to 47 volts. As capacitor 310 is charging, the base of a transistor (2N222) 318 is held high which holds transistor 318 on allowing current flow from +100 volt terminal 56 through a resistor 320 (20KΩ) through transistor 318 to ground 314. Such a current flow will cause the base of a transistor 322 (2N3440) through a resistor 324 (5KΩ) to be held low which holds transistor 322 off preventing charging of fire pulse circuit 300 until keep alive circuit 302 is fully charged.

During the time generator 18 is providing power, i.e. prior to impact while saddle 12 is still on the bomb, a +6 volt power is supplied at second PCB terminal 111 as described earlier. The +6 volts pass through a diode 326 (1N4942), which prevents reverse current flow, through a 6.2 volt zener diode 328 (1N753A) to a filtering capacitor 330 (0.1 microfarad/50 volts), coupled to +5 volt terminal 117 of microcomputer 25, and to ground 332 to provide power to microcomputer 25. It should be observed that the base of a transistor 3321 (2N3440) is held high by a 47 volt zener diode 316 through a resistor 334 (20KΩ), through a 6.2 volt zener diode 335 (1N753A) which holds transistor 332 on to pass additional current through a diode 336 (1N4942) to +5 volt terminal 117 of microcomputer 25 while generator 18 is functioning.

Upon impact, generator 18 is presumed destroyed and therefore provides no more power to second PCB +100 volt terminal 56 or +6 volt terminal 111. At such time, post impact, capacitor 310 discharges through a diode 338 (1N914) to ground 332 and through transistor 3321, diode 336, zener diode 328 and capacitors 330, to supply post impact, keep alive power, to +5 volt terminal 117 of microcomputer 25, and timing circuit 304.

Referring now to fire pulse circuit 300 of FIG. 3, once capacitor 310 is fully charged, the base of transistor 318 is held low which turns off transistor 318. A 47 volt zener diode 340 (1N4756A) in series with transistor 322 is now able to hold the base of transistor 322 high, which locks transistor 322 on, allowing current to pass from second PCB +100 volt power terminal 56 through a diode 342 (1N4942), to a fire pulse storage capacitor, i.e. fire pulse generator, 344 (5 microfarad/150 volts), through a diode 346 (1N4942) to ground 314, thereby charging capacitor 344 to approximately 46 volts.

Fire pulse trigger terminal P12 of microcomputer 25 is normally held high as is fire pulse enable terminal P27. A high on terminal P12 through a resistor 348 (5KΩ) holds the base of a transistor (fire transistor) 350 (2N2907) high which holds transistor 350 in an off condition. Correspondingly, a high on enable terminal P27, along with a high on terminal P12, through resistor 348, resistor 352 (20KΩ) and resistor 354 (10KΩ), holds the base of a transistor 356 (2N2222) high which locks transistor 356 on.

When microcomputer 25, as programmed, has determined that detonation time has arrived the fire pulse trigger circuit functions as follows.

Enable terminal P27 goes low, and shuts off transistor 356. Subsequently, fire terminal P12 goes low and transistor 350 turns on allowing current to flow from terminal P27 through resistor 354, through another resistor 358 (5KΩ) through transistor 350, through a diode 360 (1N914) through a resistor 362 (200Ω) to ground 314 as well as to the gate of a silicon controlled rectifier (SCR) 364 (2N882). A high on the gate of SCR 364 turns SCR 364 on thereby allowing fire storage capacitor 344 to discharge through SCR 364, through a diode 366 (1N4942), through positive to negative detonator terminals, through diode 346 to ground 314.

Referring now to the timing and reset circuit, dashed box 304, the base of a reset transistor 368 (2N2907) is held high by microcomputer 25 terminal P17, normally high, through a resistor 369 (5KΩ) which holds reset transistor 368 in an off condition until a reset command is given by terminal P17 going low. Microcomputer terminal $\overline{\text{RESET}}$ is also held high which charges a capacitor 370 (1 microfarad/35 volts) through ground 332, when reset transistor 368 is in an off condition.

Microcomputer 25 timing terminals XTAL1 and XTAL2 connect to an oscillator network comprising an inductor coil 372 (40 microhenry) coupled across two capacitors 374 and 376 (20 microfarad each) wired in parallel to ground 332 to provide a resetable timing circuit for microcomputer 25.

To reset the timing circuit, terminal P17, normally high, goes low. A low asserted on the base of reset transistor 368 locks the transistor on. Capacitor 370 then discharges through reset transistor 368 which in effect asserts a low on microcomputer 25 $\overline{\text{RESET}}$ terminal indicating to the microcomputer that a new time "0" has been established.

Figure 4:
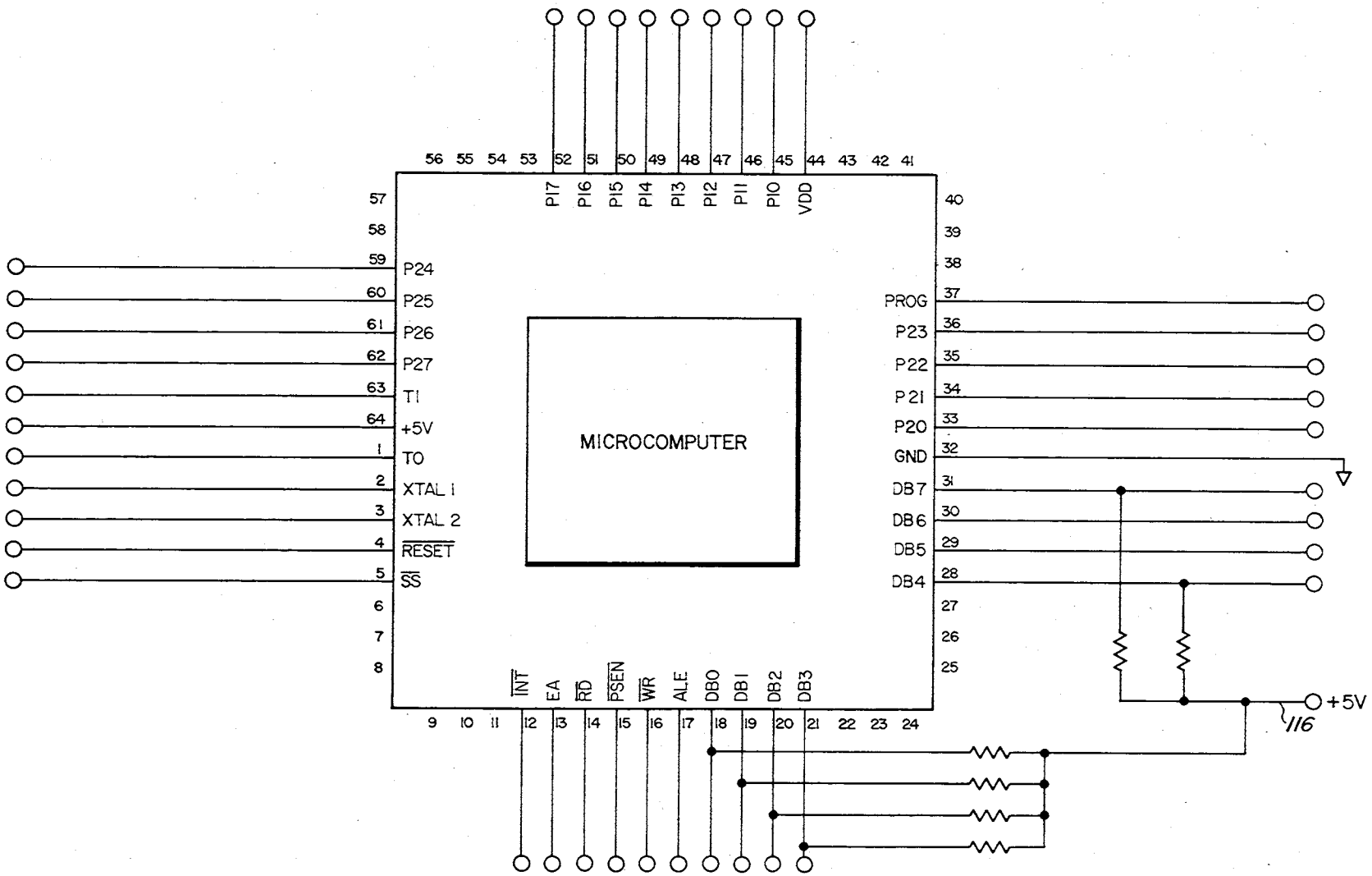
FIG. 4 is a schematic of the microcomputer on the survivor PCB.

Referring now to FIG. 4, the remaining component of survivable second PCB 26 will be described. FIG. 4 discloses microcomputer 25 which may be an Intel 8748 NMOS, 8-bit user, eraseable programmable read-only memory (EPROM) single component microcomputer.

Connections for microcomputer 25 terminals are as follows:

1: To—contact sensor input
2: XTAL1—oscillator/timing circuit
3: XTAL2—oscillator/timing circuit
4: $\overline{\text{RESET}}$—power on input
5: $\overline{\text{SS}}$—single step input for debugging
12: $\overline{\text{INT}}$—power interrupt input, leads to microcomputer interrupt routine to reset itself
13: EA—external access to memory for debugging to verify program in EPROM
14: $\overline{\text{RD}}$—output strobe for bus read to put data on bus
15: $\overline{\text{PSEN}}$—program strobe enable
16: $\overline{\text{WR}}$—output strobe during bus write
17: ALE—address latch enable/clock output
18: DB0—fire pulse delay/arming time switch input (2) input
19: DB1—fire pulse delay/arming time switch input (3) input
20: DB2—fire pulse delay/arming time switch input (4) input
21: DB3—drag sensor input
28: DB4—drag sensor input
29: DB5—motor forward stall sensor input
30: DB6—motor reverse stall sensor input
31: DB7—wind turbine generator power
32: GND—ground for microcomputer
33: P20—FFCS input
34: P21—FFCS input
35: P22—alternate FFCS input/output
36: P23—alternate FFCS input/output
37: PROG—+23 volt programming pin
44: VDD—+25 volt programming power supply and +5 volt microcomputer operational power input
45: P10—forward motor drive output
46: P11—reverse motor drive output
47: P12—fire pulse trigger output
48: P13—proximity sensor enable output
49: P14—proximity sensor range output
50: P15—arming time switch input
51: P16—fire pulse delay switch input
52: P17—power interrupt reset output allows microcomputer to reset itself
59: P24—alternate FFCS input
60: P25—extra input/output
61: P26—extra input/output
62: P27—fire pulse enable output
63: T1—proximity sensor input
64: +5 V—power input from wind turbine generator.

Figure 5:
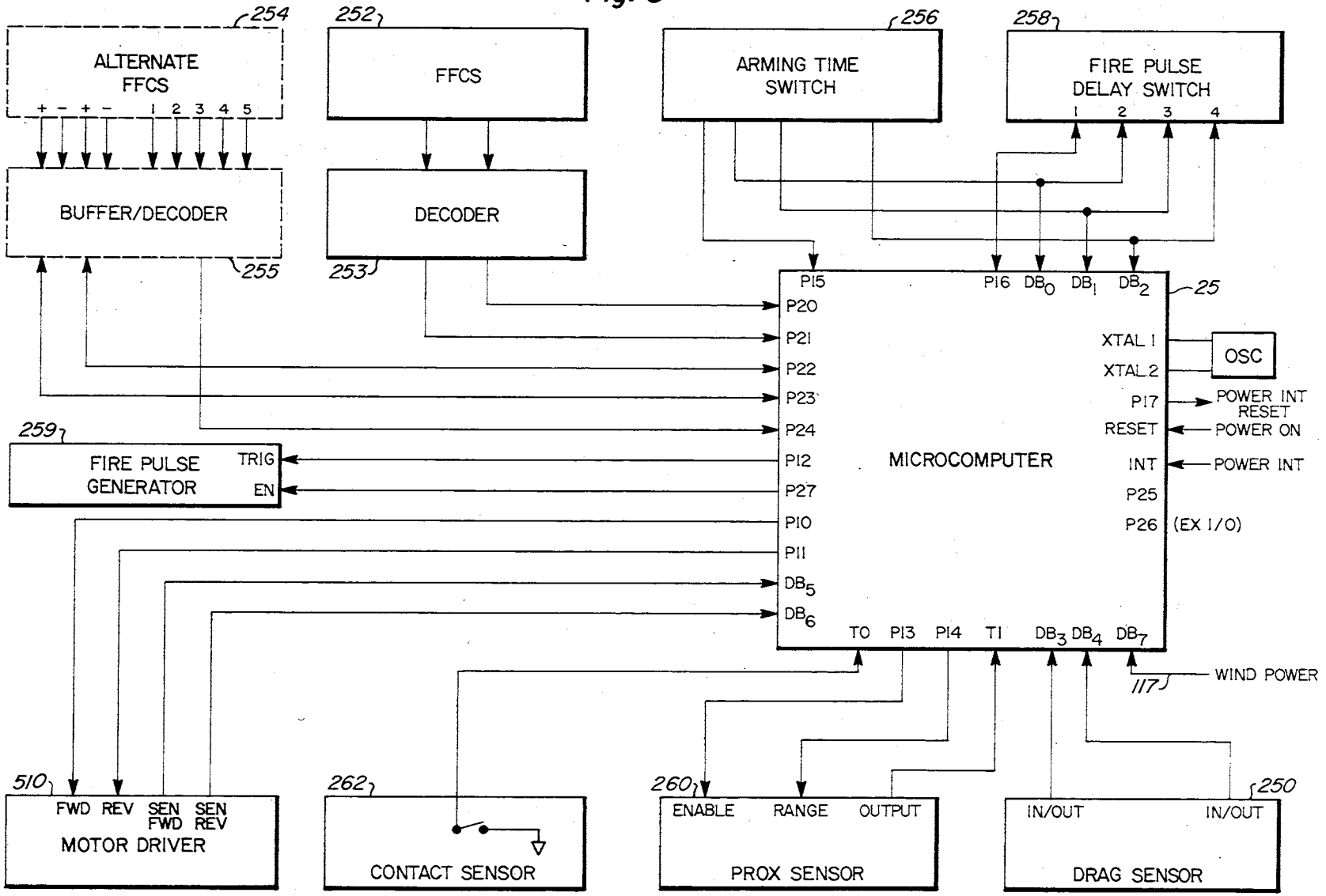
FIG. 5 is a block diagram of the various sensor and command inputs to the microcomputer.

Referring now to FIG. 5, a block diagram of microcomputer 25 and its interfaces is illustrated. Microcomputer 25 is the heart of electronic assembly 10 fuze system. Microcomputer 25 receives and processes data from various inputs to choose an arming time and a detonation delay time. The arming time is determined by inputs from a drag sensor 250 and an FFCS 252.

Bomb 11 may be provided with air friction drag brakes to slow down the velocity of bomb 11 in its flight path. Drag sensor 250 simply provides an input to terminals DB3 and DB4 of microcomputer 25 indicating whether or not these drag devices have been deployed.

FFCS 252 is a device commonly found in the cockpit of a bomb carrying aircraft and is the device that provides the ±195 volts or ±300 volts at terminals 194 and 196 of first PCB 24 of FIG. 2 to provide a code at terminals P20 and P21 of microcomputer 25.

Microcomputer 25, an 8-bit microcomputer (8748 NMOS), is also configured to receive arming and detonation delay inputs from an alternate FFCS 254 and its buffer/decoder 255 at microcomputer 25 inputs P22, P23, and P24 as an alternative to FFCS 252. Like FFCS 252, alternate FFCS 254 is a control function device commonly found in the cockpit of bomb carrying aircraft.

If microcomputer 25 is not provided with inputs from alternate FFCS 254, FFCS 252, or drag sensor 250, it will receive inputs from an arming time switch (ATS) 256 and a fire pulse/detonation delay switch (FPDDS) 258 at terminals P15, P16, DB0, DB1, and DB2 of microcomputer 25. ATS 256 and FPDDS 258 may be two rotary coded switches provided in saddle 12 (FIG. 1).

A proximity sensor 260 is a device commonly found in bomb 11 and provides an input to microcomputer 25 at terminal T1. The enable and range of sensor 260 is in turn set by microcomputer 25 at terminals P13 and P14. Sensor 260 indicates when bomb 11 is within a specific distance (range) of a target by a pulse at T1.

A contact sensor 262 likewise commonly found in bomb 11 indicates at terminal T0 of microcomputer 25 when impact with the target occurs.

Motor driver circuit 510 delineated in FIG. 2 provides forward stall and reverse stall inputs at terminals DB5 and DB6 of microcomputer 25 and motor 36 is in turn driven forward and reverse by terminals P10 and P11 of microcomputer 25.

At an appropriate time and as programmed, microcomputer 25 provides an enable and a trigger pulse to a fire pulse generator 259.

Figure 6:
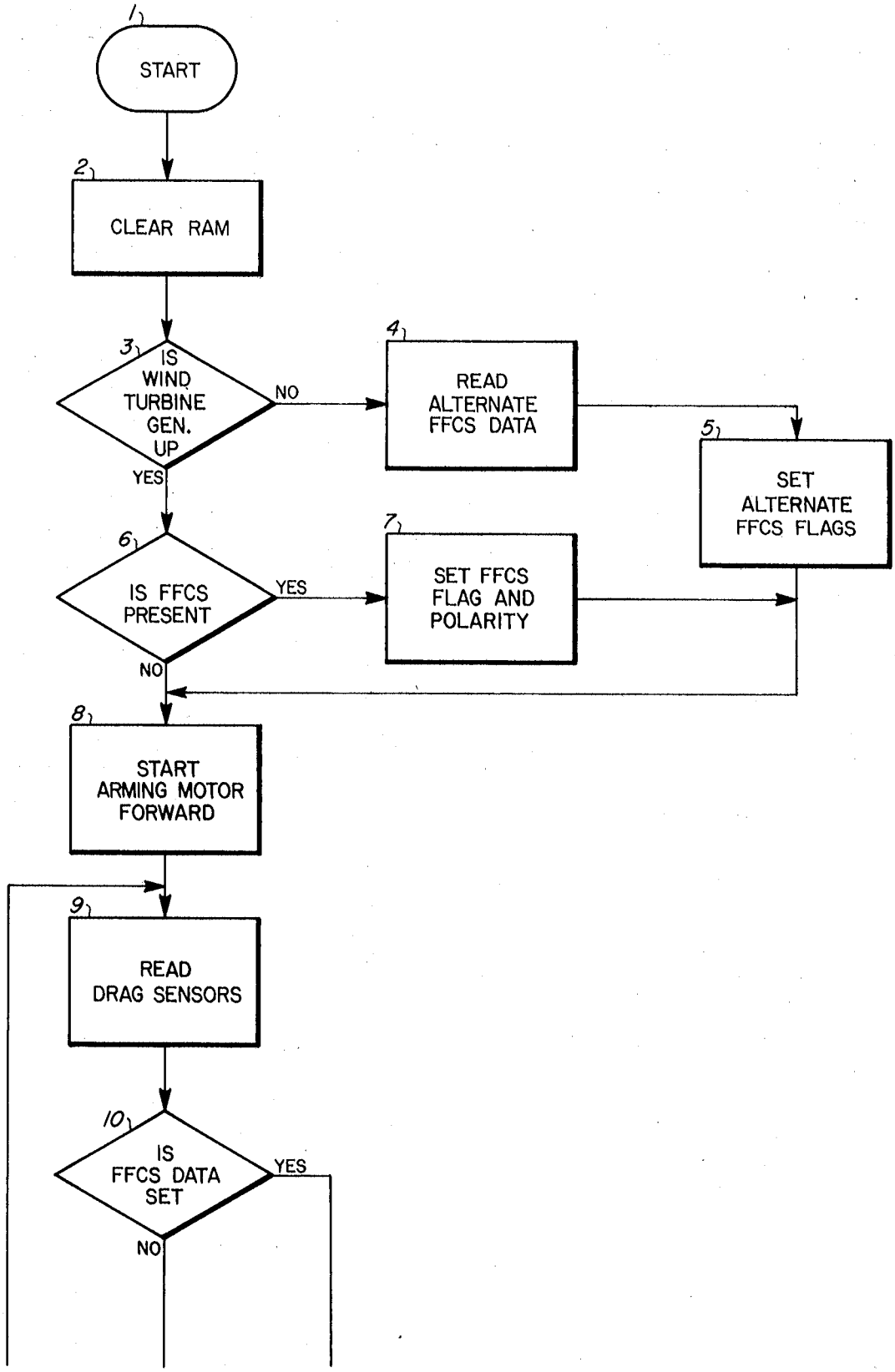
FIG. 6 is a flow chart of one possible program for the microcomputer.
Figure 6:
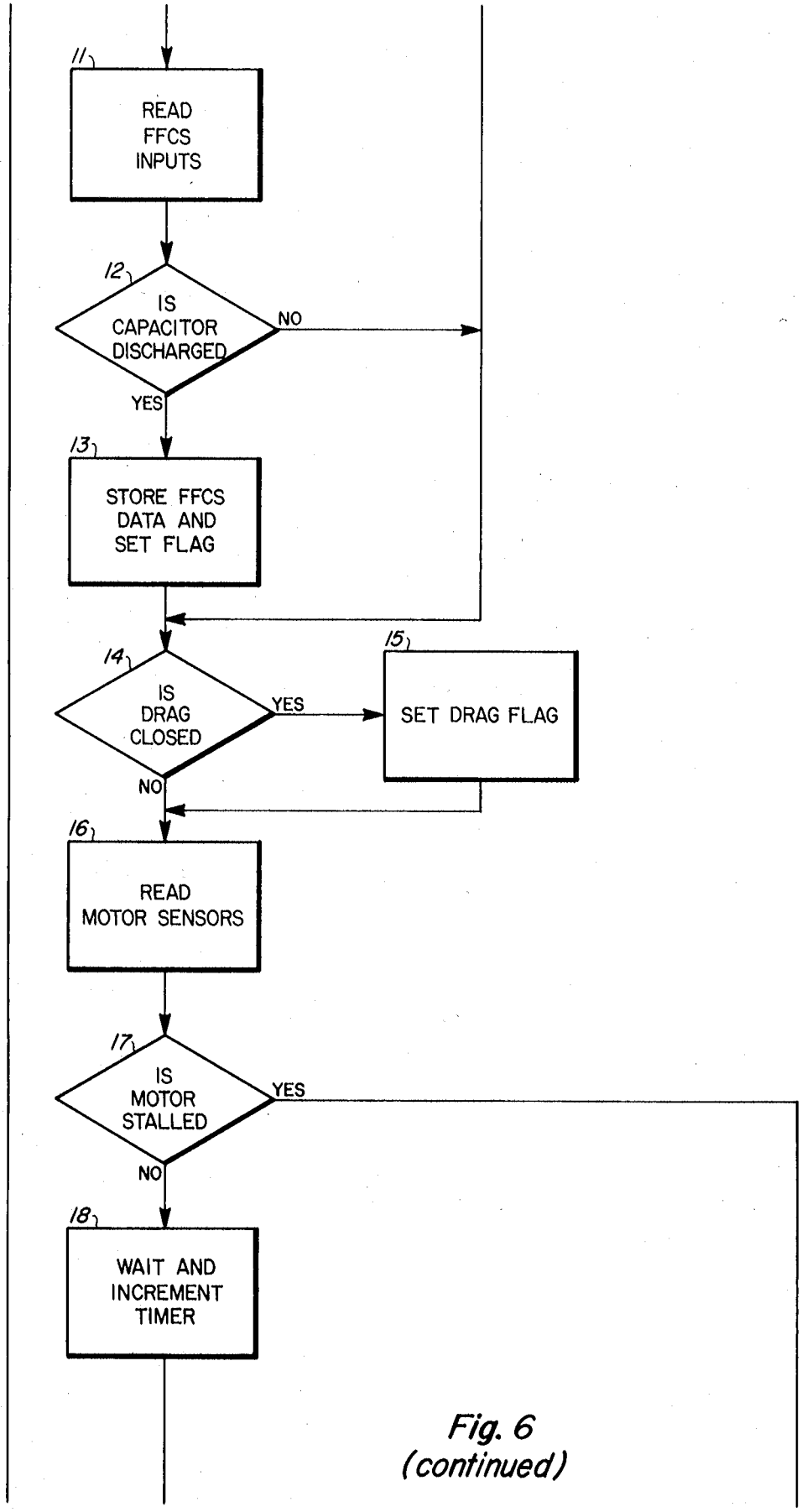
Figure 6:
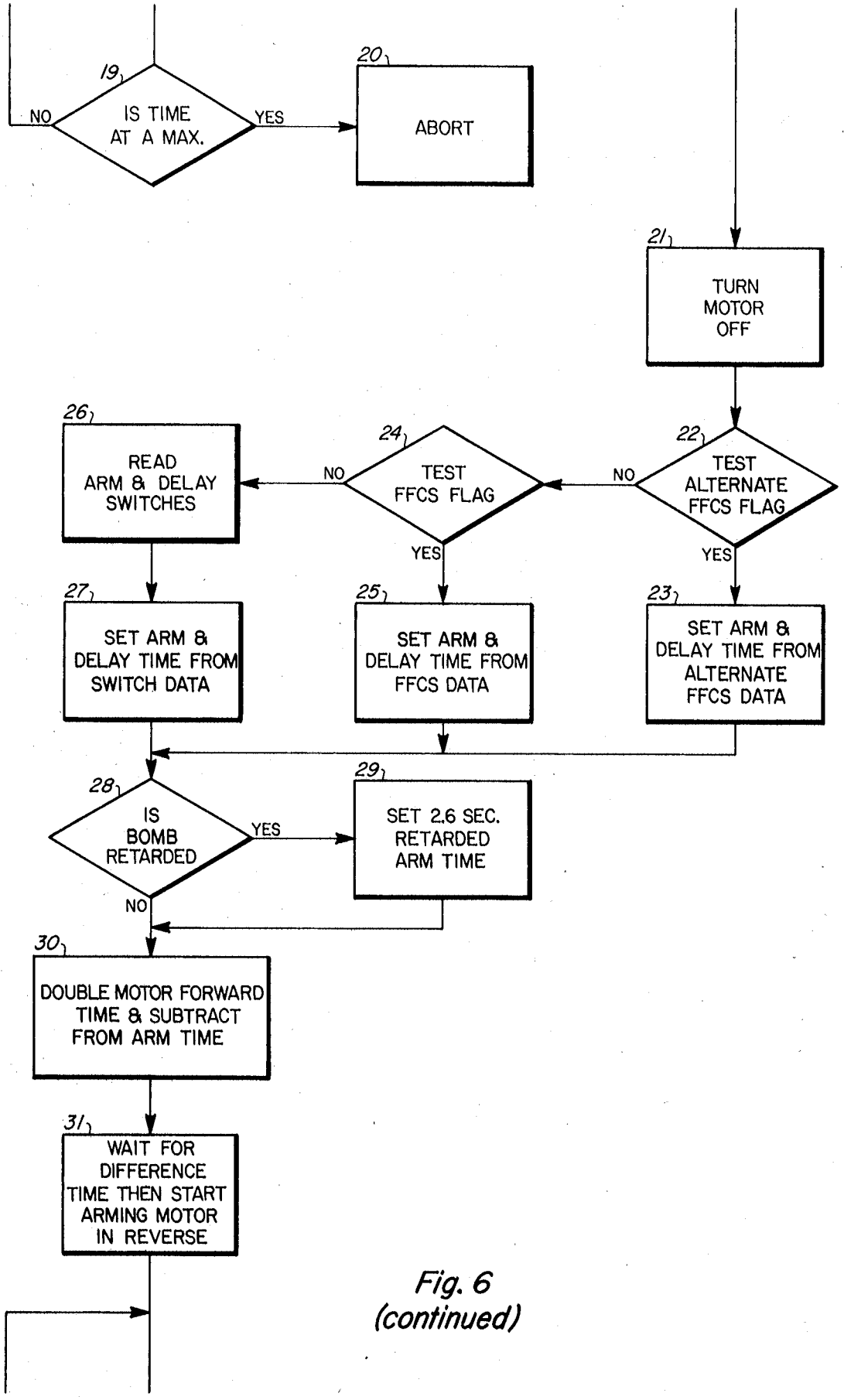
Figure 6:
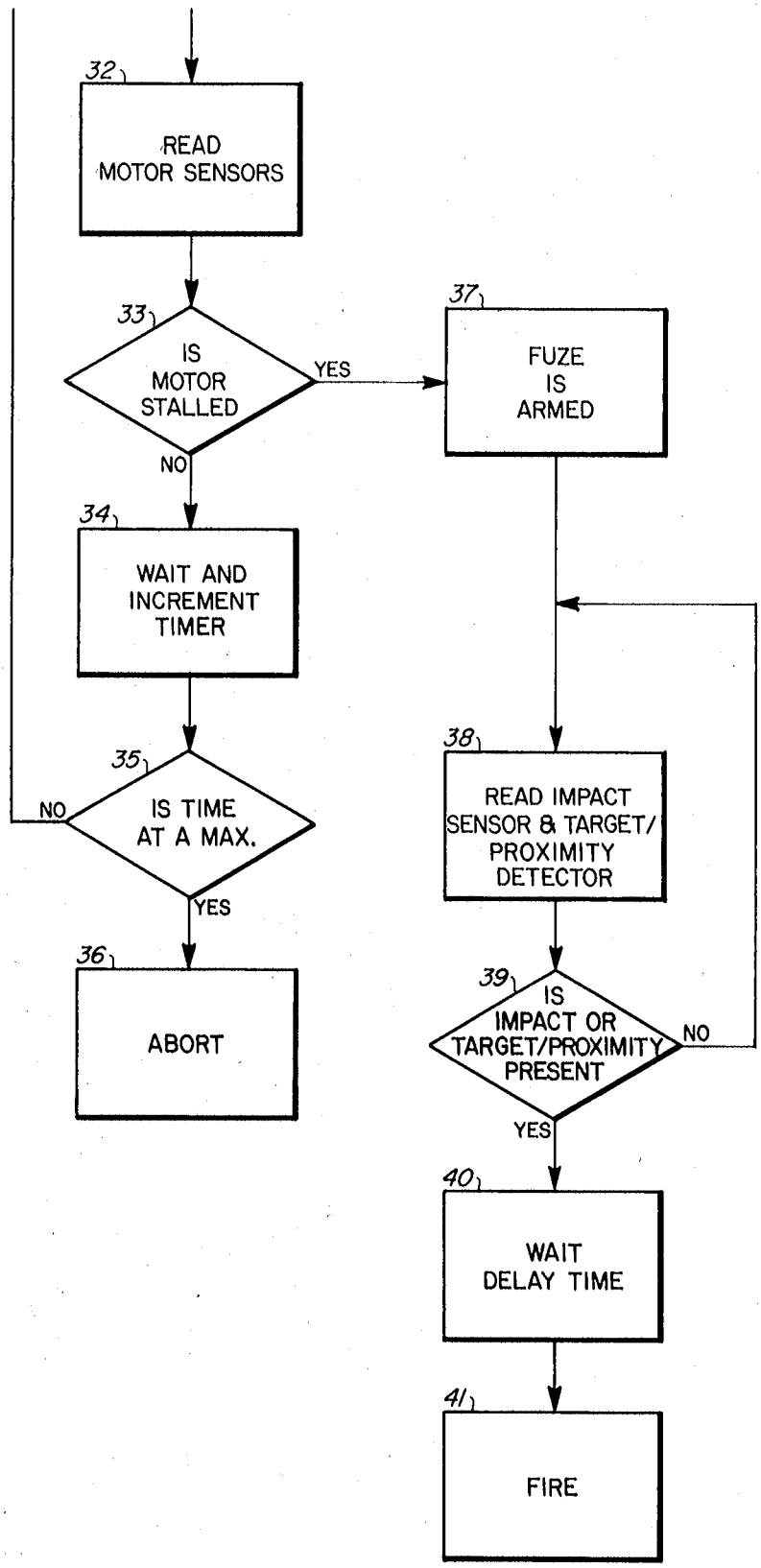

Referring now to FIG. 6, a flow chart is provided to delineate the necessary programming steps for microprocessor 25.

In block 1 (START), microcomputer 25 turns on via power directly from the bomb carrying aircraft. Initially, in block 2, the random access memory (RAM) of microcomputer 25 is cleared. In block 3, microcomputer 25 checks to confirm whether wind turbine generator 18 power source is on, i.e. whether bomb 11 has separated from the aircraft. If bomb 11 has not yet been deployed, then microcomputer 25 is still in communication with the aircraft and so in block 4 alternate FFCS 254 data is read for detonation delay commands. In block 5, microcomputer flags for alternate FFCS data are put in RAM.

If generator 18 is up (block 3), bomb 11 has been deployed, then microcomputer 25 proceeds to determine in block 6 whether an FFCS detonation delay command from the aircraft is present. If it is, then, in block 7, an FFCS flag and polarity is put into RAM. Next, block 8, microcomputer 25 commands the mechanical arming and timing circuit/motor drive circuit 510 to start motor 36 to run forward. In block 9, drag sensor 250 is read to determine whether air brakes have been deployed on bomb 11 to take into consideration, for arming time purposes, trajectory flight time of bomb 11 prior to target impact.

In block 10, a check is made to determine whether FFCS 252 data is in RAM. If FFCS data is not yet set then, block 11, FFCS data inputs are read. In block 12 a check is made to determine whether capacitors 204 or 210 are discharged, i.e. coded. If capacitors 204 or 210 of detonation delay code storage circuit 512 are discharged then the FFCS data therein is put into RAM and an FFCS flag is set, box 13. If in block 10 the FFCS data is already set or in block 12 capacitors 204 and 210 are not discharged, then the program proceeds to block 14 to determine whether drag sensor 250 indicates the bomb drag/brakes are open or closed. If drag is open then, block 15, a drag flag is set in RAM. If drag flag is set, or if there is no drag, motor 36 sensors in motor drive circuit 510 are checked, block 16. If a forward stall DB5, is not sensed, block 17, then microcomputer 25 waits and increments its timer, block 18. If too much time has elapsed, e.g. in a system malfunction, in block 19, the fuzing process is aborted, block 20.

In block 19, if insufficient time has elapsed for motor 36 to run its forward course then, the program loops back to block 9 and runs again through the foregoing steps.

If in block 17, a forward stall is sensed, motor 36 is turned off, block 21.

In block 22, a search is made for an alternate FFCS 254 flag, and if found in RAM, an arm and delay time is set from that data, block 23. If no alternate FFCS 254 flag is found, then a second search for an FFCS 252 flag is made, block 24, and if found in RAM, an arm and delay time is set from that data, block 25. If no FFCS nor alternate FFCS flags are present then, block 26, arm and delay switches 256 and 258 are read and an arm and delay time is set from that data, block 27.

Once an arm and delay time is set, a check is made to determine whether bomb 11 is retarded, block 28. That is to say, if the air brakes/snake eye fins are deployed on bomb 11, drag sensor 250 so indicating, then bomb 11 will separate from the aircraft faster than normal and so the arming time of fuze 10 can be accelerated. Arming time of fuze 10 is normally 5–10 seconds, but with a drag deployed, fuze 10 can be armed much faster, e.g. in 2.6 seconds, by block 29.

In block 30, the time of motor 36 travel to a forward stall is doubled and that product is subtracted from the arm time given in blocks 23, 25, or 27. When that time difference has elapsed, motor 36 is driven in reverse, block 31, by motor drive circuit 510.

In block 32, motor reverse stall sensor DB6 is read. If no stall is sensed, block 33, microcomputer 25 holds and increments its timer, block 34. If too much time has elapsed, block 35, for motor 36 to run its course in reverse, the system is aborted, block 36, and the fuze is shut off. If an insufficient time, block 35, has elapsed then a loop is made to block 32 to continue reading reverse sensor terminal DB6.

Once a reverse stall is sensed, block 33, the mechanical detonator alignment means is in proper position for detonation and the fuze is armed, block 37.

Impact sensor 262 and proximity sensor 260 are then continuously read, block 38. When impact is detected, block 39, microcomputer 25 in block 40 waits the appropriate detonation delay time given in blocks 23, 25 or 27 and then commands an enable and trigger fire pulse to detonate, block 41.

MODE OF OPERATION

As depicted in FIG. 5 in the block diagram of microcomputer 25 and its interfaces, the heart of electronic assembly 10 is microcomputer 25 which receives and processes data from various inputs to choose an arming time and a detonation delay time. An arming time is determined by drag sensor input 250 and the FFCS 252 or alternate FFCS 254 inputs if present; if no inputs arrive from these sources, then ground set arming time switch 256 is used. Correspondingly, a detonation delay time is obtained from FFCS 252 or alternate FFCS 254 inputs if present; if none exists, then ground set fire pulse delay switch 258 is used.

Microcomputer 25 program starts when wind turbine generator 18 (FIG. 1) comes up, at bomb release, and when microcomputer 25 reset times out.

At bomb 11 release, and immediately prior to separation of lanyard 13 from the aircraft, FFCS 252/alternate FFCS 254 sends a $\pm 195/\pm 300$ volts to terminals 194 and 196, FIG. 2, the command storage circuit indicating the pilot's desired arming time and detonation delay time.

Microcomputer 25 then energizes motor 36 (FIGS. 1 and 2) to drive it forward. While motor 36 is running microcomputer 25 measures the discharge time of capacitors 204 or 210 charged by FFCS 252 if it was utilized. This data is later used to determine if FFCS 252 was utilized and what mode it was in. The forward running time of motor 36 is measured upon sensing a forward stall DB5 (FIG. 2), and the motor is de-energized. Next, the arming delay time is determined by doubling the measured motor forward running time and subtracting it from the total desired arming time, i.e. from arming time switch 256, FFCS 252, or FFCS 254. After this delay period motor 36 is reversed and driven to the full armed state, indicated by reverse stall DB6 (FIG. 2), after which motor 36 is de-energized.

If FFCS 252 or 254 has been utilized, the fire delay is determined from that data, stored in capacitors 204 and 210 (FIG. 2); if FFCS 252 or 254 was not utilized, the fire delay is determined from fire delay switch 258.

Next, microcomputer 25 is programmed to look for target proximity sensor 260 and contact sensor 262 (FIG. 5) a gravity type switch, indications. When impact is detected, the chosen fire delay is executed, fire pulse enable P27 and fire pulse trigger P12 (FIG. 3) are asserted and the fire pulse is generated across the detonator terminals (FIG. 3).

Microcomputer 25 is normally powered from wind turbine generator 18, through voltage regulator circuit 511 at slightly over 5 volts. It is anticipated, however, that on impact, generator 18 will be destroyed and the voltage on microcomputer 25 will begin to drop. When the voltage drops to slightly below 5 volts, current is supplied from keep alive circuit 302 (FIG. 3) to power microcomputer 25, which is isolated from the power supply board (first PCB 24) by diode 326 (FIG. 3) during this time. A 6.2 volt zener diode 328 (FIG. 3) bridges across power terminals 111 and 117 to protect microcomputer 25 from over voltage transients.

While a specific embodiment of the invention has been described above, further embodiments and combinations of components described herein will be apparent to those skilled in the art without departing from the spirit of the invention.

What is claimed is:

1. A microcomputer controlled electronic assembly for a target penetrator bomb fuze capable of withstanding a 100,000 g impact and of interfacing with a plurality of components including, a fuze contact, proximity, and drag sensor,
a fuze mechanical timing and alignment device,
a fire pulse delay switch and arming time switch,
a Fuze Function Control Set (FFCS) and an alternate FFCS,
a wind turbine generator, and
a fire pulse generator, comprising:

a power conversion circuit coupling said wind turbine generator to said mechanical timing and alignment device and to said microcomputer;
a detonation delay code storage circuit, coupling said FFCS to said microcomputer;
means for coupling said alternate FFCS to said microcomputer;
a sensor lead coupling said contact, proximity, and drag sensors to said microcomputer;
a switch lead coupling said arming time switch and said fire pulse delay switch to said microcomputer;
a motor drive circuit coupling said mechanical timing and alignment device to said microcomputer;
a power storage circuit, keep alive circuit, capable of withstanding a 100,000 g impact, coupling said wind turbine generator to said microcomputer;
a timing circuit, capable of withstanding a 100,000 g impact, coupled to said microcomputer; and
a fire pulse circuit, capable of withstanding a 100,000 g impact, coupling said fire pulse generator to said microcomputer.

2. An electronic assembly according to claim 1, wherein said power conversion circuit contains means for converting power from AC to DC.

3. An electronic assembly according to claim 2, wherein said converting means consists of a bridge DC/full wave rectifier.

4. An electronic assembly according to claim 1, wherein said power conversion circuit contains means for reducing power from a high voltage to a low voltage.

5. An electronic assembly according to claim 4, wherein said reducing means consists of a five volt regulator.

6. An electronic assembly according to claim 1, wherein said power conversion circuit contains means for smoothing out AC-DC power at a predetermined level.

7. An electronic assembly according to claim 6, wherein said charge storing means consists of a zener diode and a first and second series capacitors, said zener diode being in parallel to said series capacitors.

8. An electronic assembly according to claim 1, wherein said detonation delay code storage circuit contains means for temporarily holding a positive and negative first voltage level, and a positive and negative second voltage level code from said FFCS and said alternate FFCS.

9. An electronic assembly according to claim 8, wherein said holding means consists of a first input lead in parallel with a second input lead.

10. An electronic assembly according to claim 9, wherein said first input lead has a first diode to ground, in parallel with a first capacitor to ground, in parallel with a first diode from ground.

11. An electronic assembly according to claim 10 wherein said first input lead has a first reversed biased diode coupled between said first diode to ground and said first capacitor to ground.

12. An electronic assembly according to claim 10 wherein said first input lead has a first resistor coupled between said first capacitor to ground and said first diode from ground.

13. An electronic assembly according to claim 9 wherein said second input lead has a second diode to ground in parallel with a second capacitor to ground, in parallel with a second diode from ground.

14. An electronic assembly according to claim 13, wherein said second input has a second reversed biased diode coupled between said second diode to ground and said second capacitor to ground.

15. An electronic assembly according to claim 13, wherein said second input lead has a second resistor coupled between said second cpacitor to ground and said second diode from ground.

16. An electronic assembly according to claim 1, wherein said motor drive circuit provides means, controlled by said microcomputer, for driving said mechanical timing and alignment device forward and for sensing a forward stall, then for driving said mechanical timing and alignment device in reverse and for sensing a reverse stall.

17. An electronic assembly according to claim 1, wherein said power storage circuit provides means for storing sufficient charge, during wind turbine generator up time, to provide a five volt power source to said microcomputer when said wind turbine generator is destroyed.

18. An electronic assembly according to claim 1, wherein said timing circuit provides means for timing and resetting said microcomputer.

19. An electronic assembly according to claim 1, wherein said fire pulse circuit provides means for storing a fire pulse charge, microcomputer controlled means for enabling a fire pulse, and microcomputer controlled means for triggering said fire pulse.

20. An electronic assembly according to claim 1 having a first and a second PCBs, wherein said power conversion circuit, said detonation delay code storage circuit, and said motor drive circuit are contained by said first PCB, and said power storage circuit, said timing circuit, said fire pulse circuit, and said microcomputer are contained by said second PCB which is capable of surviving a 100,000 g impact.

21. An electronic assembly according to claim 20, wherein said first and second PCBs are potted.

* * * * *